US005917456A

United States Patent [19]

Teunisse

[11] Patent Number: 5,917,456

[45] **Date of Patent: *Jun. 29, 1999**

[54] STRIPLINE ANTENNA

[75] Inventor: Petrus Johannus Stephanus Teunisse, EG Hengelo, Netherlands

[73] Assignee: Hollandse Signaalapparaten B.V., Hengelo, Netherlands

[ * ] Notice: This patent issued on a continued prosecution application filed under 37 CFR 1.53(d), and is subject to the twenty year patent term provisions of 35 U.S.C. 154(a)(2).

[21] Appl. No.: 08/845,209

[22] Filed: Apr. 21, 1997

Related U.S. Application Data

[63] Continuation of application No. 08/516,762, Aug. 18, 1995, abandoned.

[30] Foreign Application Priority Data

Sep. 2, 1994 [NL] Netherlands ..... 9401429

[51] Int. Cl.[6] ..... H01Q 1/38; H01Q 21/00

[52] U.S. Cl. ..... 343/795; 343/821

[58] Field of Search ..... 343/795, 813–817, 343/819–821; H01Q 21/06, 21/08, 21/10, 21/12

[56] References Cited

U.S. PATENT DOCUMENTS

| | | | |
|---|---|---|---|
| 3,750,185 | 7/1973 | Evans | 343/814 |
| 3,761,843 | 9/1973 | Cappuchi | 333/112 |
| 4,495,505 | 1/1985 | Shields | 343/821 |
| 4,516,132 | 5/1985 | Bond et al. | 343/815 |
| 5,012,256 | 4/1991 | Maddocks | 343/813 |
| 5,172,128 | 12/1992 | Bouko et al. | 343/795 |
| 5,285,212 | 2/1994 | McNiece | 343/795 |

FOREIGN PATENT DOCUMENTS

| | | | |
|---|---|---|---|
| 0 186 455 | 7/1986 | European Pat. Off. . | |
| 2020192 | 11/1971 | Germany | 343/700 MS |
| 58-62902 | 4/1983 | Japan | 343/795 |

OTHER PUBLICATIONS

IEEE Transaction on Antennas and Propagation, "Mutual Coupling Between Metal Strip Antennas on Finite Size, Electrically Thick Dielectric Substrates", Parfitt, et al. vol. 41, Jan. 1, 1993, New York, USA. pp. 108–115.

Conference Proceedings Military Microwaves, "Progress in Printed Circuit Array Antennas", Mailloux Jul., 1998, London, England. pp. 293–298.

*Primary Examiner*—Michael C. Wimer
*Attorney, Agent, or Firm*—Oblon, Spivak, McClelland, Maier & Neustadt, P.C.

[57] ABSTRACT

The invention relates to an antenna in stripline technology, in which the dipoles and the feeder network are etched in one single process. The connections of the dipoles are realized as two-wire transmission lines, fed by Schiffman couplers. The polarization of the antenna is selectably chosen by twisting the transmission lines.

6 Claims, 2 Drawing Sheets

STRIPLINE ANTENNA

This application is a Continuation of application Ser. No. 08/516,762, filed on Aug. 18, 1995, now abandoned.

BACKGROUND OF THE INVENTION

The present invention relates to a stripline antenna provided with a feeder network connected to a linear array of dipole antennas.

Stripline antennas of this type are for instance used in two-dimensional antenna arrays in which a stack of receive-antenna beams are generated by means of digital beam forming networks. A single antenna array will usually comprise some tens of stacked stripline antennas, each provided with for instance fifty dipole antennas. It is of major importance then to realise the feeder networks and the dipole antennas as lightweight and low-cost constructions, without impairing the quality.

SUMMARY OF THE INVENTION

The stripline antenna according to the invention is thereto characterized in that the feeder network and the dipole antennas have been realized by etching of a single plated sheet of synthetic material. This particularly enhances the reproducibility of the production process, which minimizes the percentage of rejects and greatly simplifies calibration procedures.

A favourable embodiment of the stripline antenna according to the invention is characterized in that the feeder network is disposed insulated between two ground planes. This yields a functional stripline antenna in which the antenna array can subsequently be obtained by stacking a required number of stripline antennas.

A favourable special embodiment is obtained by using synthetic foam as insulating material. This is favourable because of its low weight and low dielectric losses; moreover, the two ground planes will protect the vulnerable synthetic foam from damages incurred during storage and transport.

A dipole antenna is provided with two connections to be preferably fed in phase opposition. According to the state of the art, two separate distribution networks will usually be provided, each of which feeds a connection of the dipole antennas and which are themselves fed in phase opposition. According to a further favourable embodiment of the invention, the feeder network comprises only a single distribution network and per dipolel antanna a phase-shifting network, for feeding both dipole antenna connections in phase opposition. To this end, a balun well-known in the art may be employed, for instance implemented as a Schieffman coupler.

Since the dipole antennas are required to radiate unobstructed, they have been positioned outside the ground planes, the connection to a phase-shifting network being effected via a two-wire transmission line having an impedance that matches the impedance of a dipole antenna. This has the unexpected effect that at least substantially no reflection occurs in the area where a two-wire transmission line leaves the two ground planes, provided that at that position the characteristic impedance of the two-wire transmission line is adapted in a manner known in the prior art. This is all the more surprising since, within the ground planes, the electromagnetic field surrounding the transmission lines is in the stripline mode, whereas outside the ground planes, it is in the two-wire transmission line mode. This mode transition evidently proceeds smoothly.

An exceptionally favourable embodiment of the stripline antenna is obtained by removing the superfluous parts of synthetic material surrounding the dipole antennas and the transmission lines. This will cause the dipole antennas to be loosely suspended from the transmission lines which, by the incorporation of a mechanical support, allows them to be set to any required angle, resulting in an antenna radiation field with an adjustable polarization. In a feeder network that is in the horizontal position during its standard mode of operation, it is for instance possible to place the dipole antennas in a vertical position, which yields a vertically polarized radiation field.

BRIEF DESCRIPTION OF THE DRAWINGS

The invention will now be explained in more detail with reference to the following figures, of which.

DETAILED DESCRIPTION OF THE INVENTION

Figure 1:
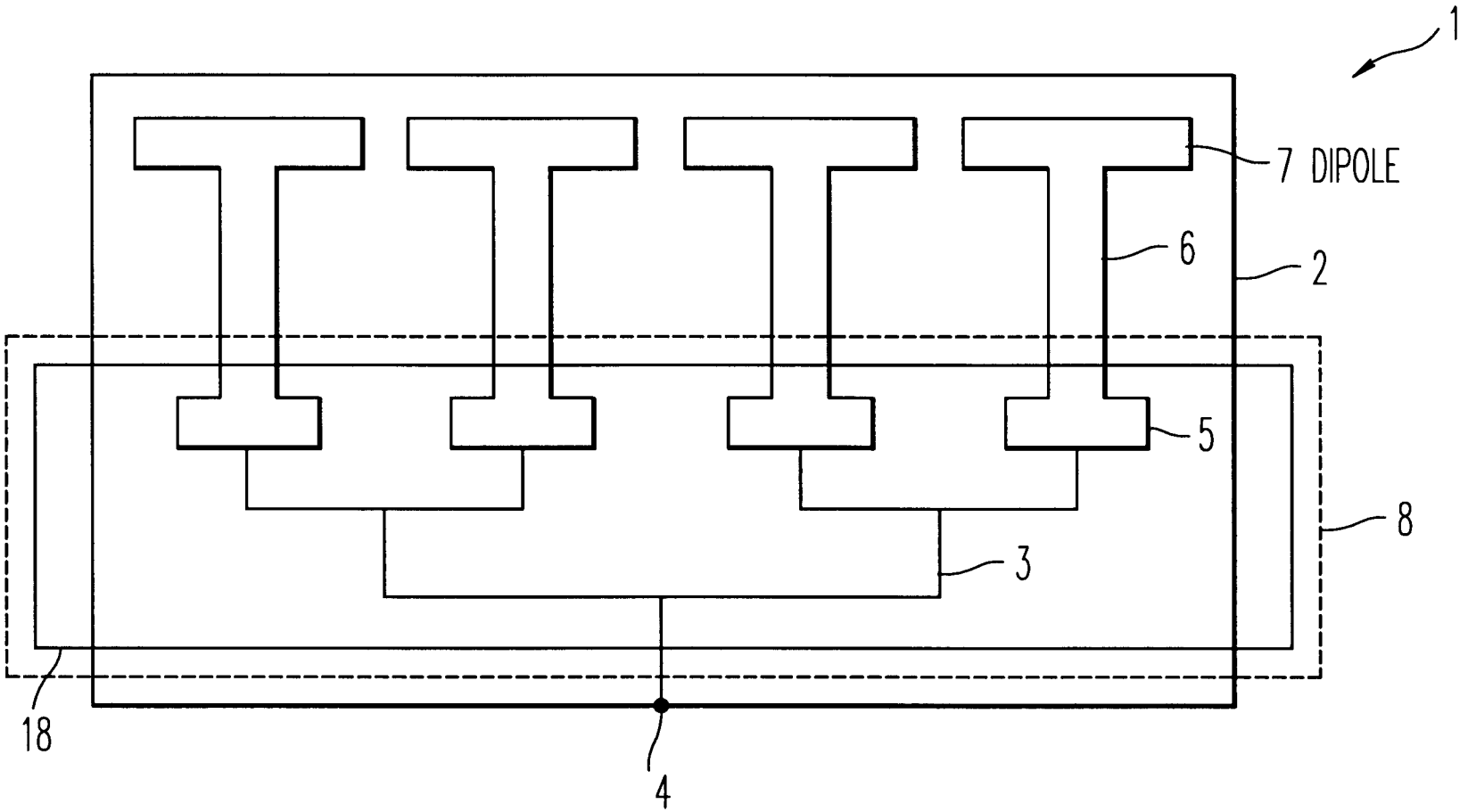
FIG. 1 schematically represents a stripline antenna according to the invention.

FIG. 1 schematically represents a stripline antenna 1 according to the invention in which a sheet of synthetic material 2, for instance Kapton, is provided with a conductor pattern 3 on the basis of which RF energy, supplied via a feed point 4, is distributed and is transmitted to dipole antennas 7 via phase-shifting networks 5 and connections 6. Conductor pattern 3, phase-shifting networks 5, connections 6 and dipole antennas 7 have all been realized in a single process by etching a plated, in general copper-plated, sheet of synthetic material 2. The stripline antenna 1 is disposed insulated between two ground planes 8, usually made of aluminium, the dipole antennas 7 and part of the connectors 6 protruding beyond the ground planes. The insulation is preferably realized by inserting, between the aluminium ground planes 8 and on both sides of the sheet of synthetic material, a layer of synthetic foam 18 of a type that is characterized by low dielectric losses and possesses non-hygroscopic properties. Within the frequency range of the stripline antenna, phase shifters 5 have an at least substantially constant phase shift, such that the connections 6 of dipole antenna 7 are powered in phase opposition. Additionally, phase-shifting networks 5 provide for the transformation of an asymmetric stripline mode in conductor pattern 3 to a symmetric stripline mode in at least that part of the connection 6 located between the ground planes 8. Furthermore, the impedance of the stripline is matched to the impedance of the dipole. Such networks are known in the art and are also referred to as baluns.

Stripline antenna 1 can of course also be used for reception in which case the RF radiation received by dipole antennas 7 is concentrated within the frequency range of the stripline antenna 1 and is subsequently supplied to feed point 4.

Figure 2:
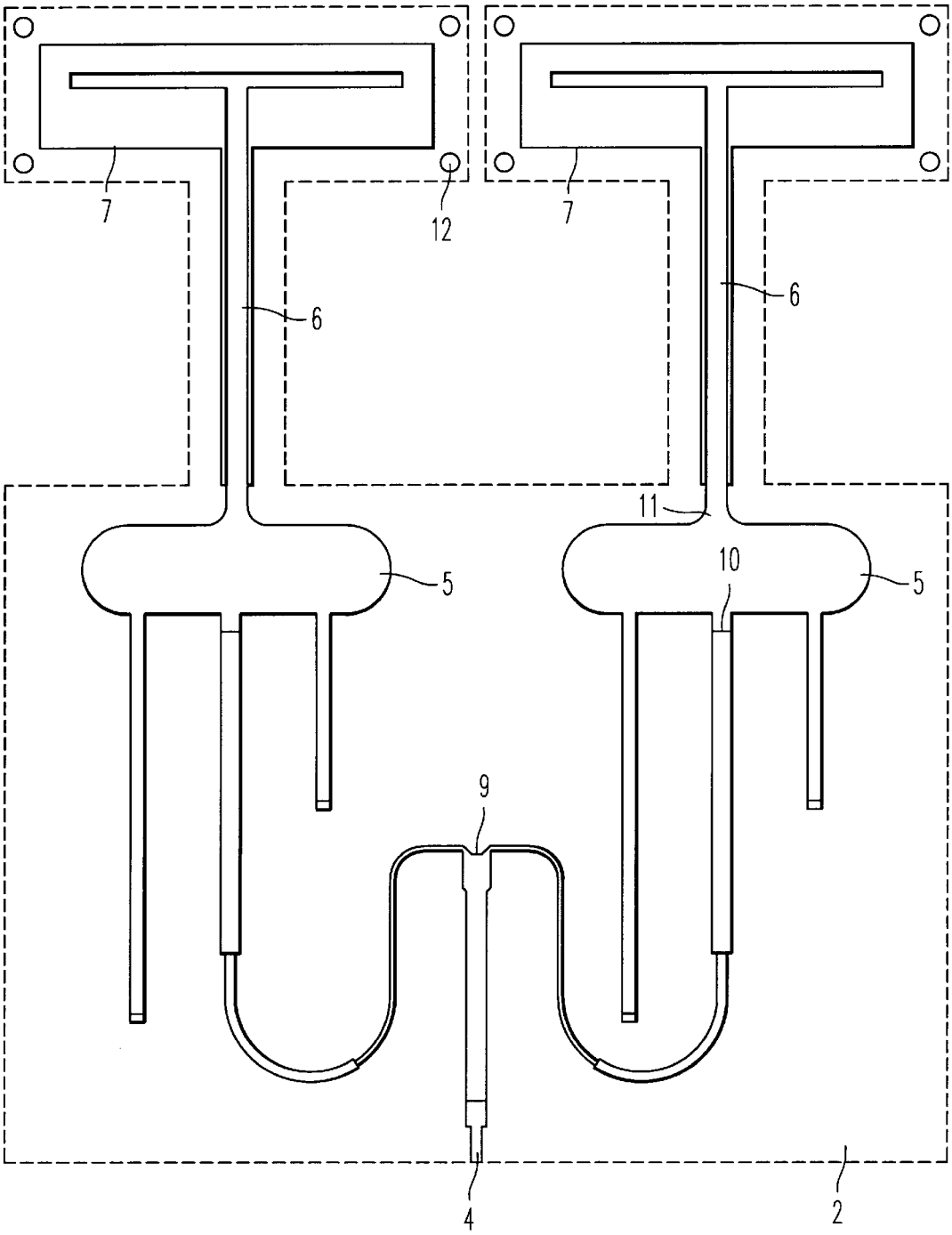
FIG. 2 represents a part of the stripline antenna according to the invention.

FIG. 2 shows a part of the stripline antenna according to the invention, which part can be regarded as a stripline antenna incorporating two dipole antennas 7. RF energy is supplied to feed point 4 after which it is distributed by means of a splitter 9. This distribution need not be symmetrical, which enables a certain tapering across stripline antenna 1. The RF energy is subsequently supplied to phase-shifting networks 5 implemented as Schiffman couplers in which the energy via a symmetrical splitter 10 and two different path lengths and subsequently via connections 6 is transmitted to dipole antennas 7. The connections 6 between phase-shifting networks 5 and dipole antennas 7 are partially positioned between the ground planes 8 and partially extend beyond the ground planes 8. In view of this, impedance matching is required, which is effected in transition 11 by adjusting the width of the print track. Surprisingly, this transition 11 is found to introduce at least substantially no reflections or losses, in spite of the mode patterns between and outside the ground planes being totally different.

The removal of superfluous parts of the sheet of synthetic material 2, as shown in FIG. 2, results in dipole antennas that are freely suspended from the connections 6. Moreover, it surprisingly appears that any twisting or bending of the connections 6 has practically no adversely affect on the behaviour of the combination of connection 6 and dipole antenna 7. It is therefore possible, for instance by means of the through-holes 12 in the sheet of synthetic material 2, to mount the dipole antennas at a predetermined angle on a support structure not shown here, which yields a stripline antenna with a predetermined polarization direction.

The stripline antenna according to the invention can be employed in a wide frequency range, where the dimensions of the component parts and the thickness of the layer of synthetic foam will have to be selected in accordance with the selected operating frequency, according to methods well-known in the prior art.

I claim:

1. A stripline antenna having a predetermined polarization direction comprising:

a plurality of dipole antennas each having two connections;

a feed or network including a plurality of phase-shifting networks, one for every dipole antenna, for feeding both dipole antenna connections with opposite phases; and a plurality of two-wire transmission lines, one for each dipole, for connecting the dipole antennas to the phase-shifting networks;

two ground planes for enclosing at least the phase-shifting networks;

where the dipole antennas, the phase-shifting networks and the two-wire transmission lines consist of an etched pattern on one side of a single sheet of plated synthetic material and where all dipole antennas have a predetermined angle relative to the feeder network, which angle is obtained by twisting the two-wire transmission line.

2. Stripline antenna as claimed in claim 1, characterized in that a layer of synthetic foam is used as insulating material between said two ground planes.

3. Stripline antenna as claimed in claim 2, characterized in that the feeder network comprises a distribution network and per dipole antenna a phase-shifting network, for feeding both dipole antenna connections in phase opposition.

4. Stripline antenna as claimed in claim 3, characterized in that the phase-shifting network comprises a balun.

5. Stripline antenna as claimed in claim 1, where in the plurality, of two-wire transmission lines having impedances that match the impedances of the dipole antennas.

6. Stripline antenna as claimed in claim 1, wherein in a standard mode of operation the feeder network is in a horizontal position, whereas the dipole antennas are in a vertical position, for realizing a vertical polarization antenna.

* * * * *